United States Patent [19]

Felder

[11] 4,296,678

[45] Oct. 27, 1981

[54] POLISH ROD JACK SYSTEM

[76] Inventor: Donald W. Felder, 1609 S. Vaden, Sherman, Tex. 75090

[21] Appl. No.: 11,692

[22] Filed: Feb. 12, 1979

[51] Int. Cl.[3] ..... F01B 31/14; F15B 15/24

[52] U.S. Cl. ..... 92/13.1; 74/41; 74/583

[58] Field of Search ..... 417/44, 43, 46, 31, 417/38; 92/13, 13.1; 166/105; 74/583, 586, 41

[56] References Cited

U.S. PATENT DOCUMENTS

| | | | |
|---|---|---|---|
| 2,237,303 | 4/1941 | Calhoun | 74/583 |
| 2,698,578 | 1/1955 | Anderson | 74/583 |
| 3,051,237 | 8/1962 | Liles, Jr. et al. | 74/583 X |
| 3,554,093 | 1/1971 | Lonnemo | 92/13.1 |
| 3,679,326 | 7/1972 | Weber | 417/38 |
| 4,118,148 | 10/1978 | Allen | 417/44 X |
| 4,119,865 | 10/1978 | Elderton | 417/43 |
| 4,124,331 | 11/1978 | Taki | 417/44 |

*Primary Examiner*—H. C. Hornsby
*Attorney, Agent, or Firm*—Harrington A. Lackey

[57] ABSTRACT

A polish rod jack system for an oil well pumping units that utilizes a sucker rod; incorporating a hollow hydraulic ram to raise and lower the sucker rod string; hoses and tubing to connect the hydraulic ram to a remote manifold and in turn to a hydraulic pumping source; a hydraulic and electric switchgage to stop a prime mover in the event of pumping unit and system malfunctions and or failures; quick-disconnect fittings to facilitate connection and disconnection of the hydraulic ram from the system when the well is being serviced and to allow rapid connection and disconnection of a hydraulic pump at the remote hydraulic manifold to allow the bottom hole pump to be respaced and fine tuned while the pumping unit is in operation to maximize production.

3 Claims, 4 Drawing Figures

FIG 1
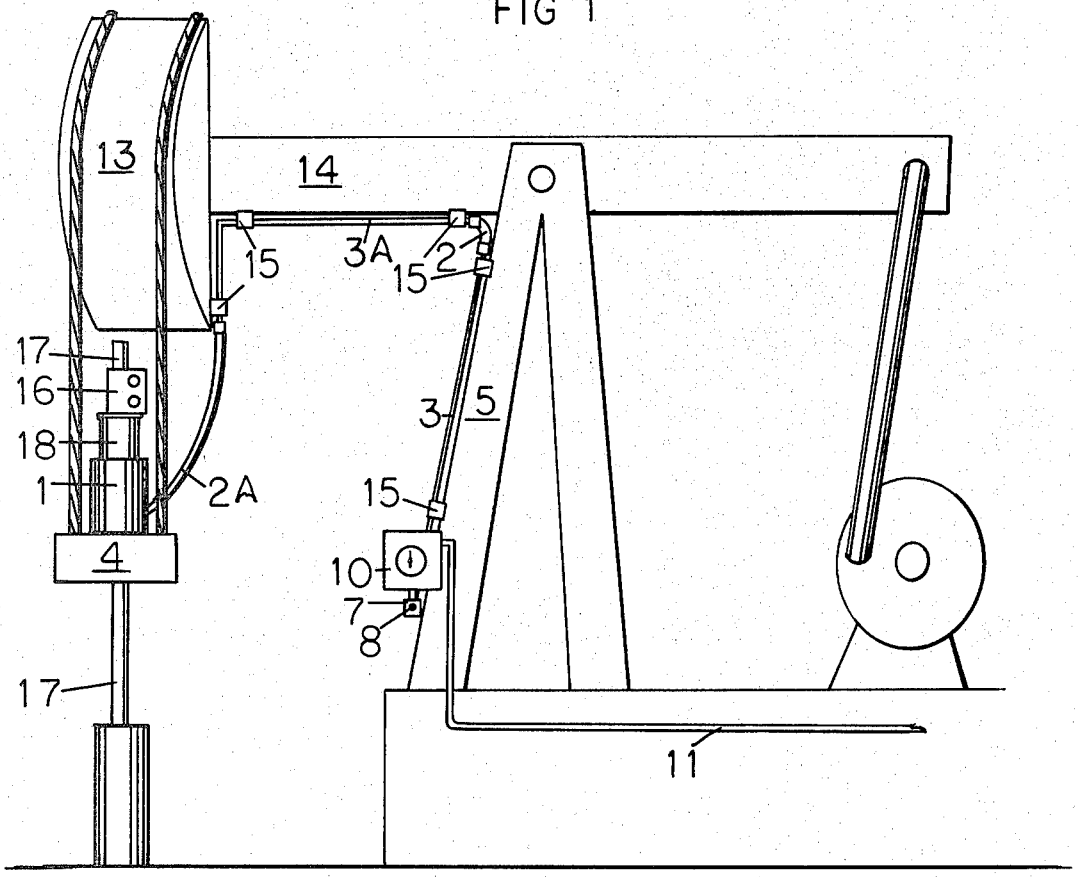
FIG 2
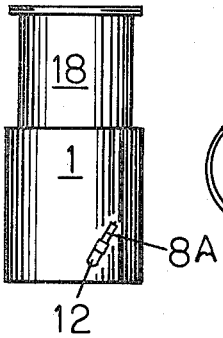
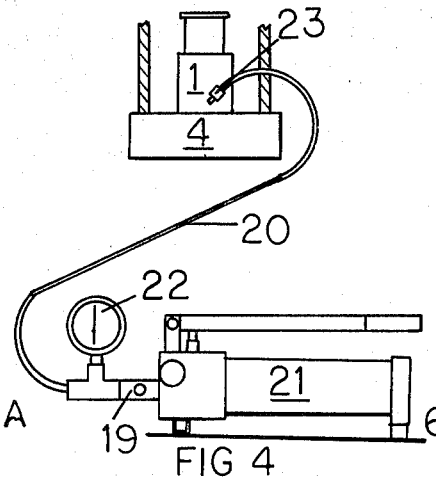
FIG 4
FIG 3
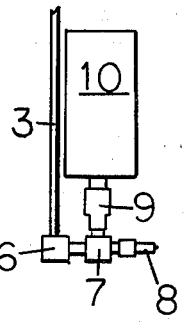

POLISH ROD JACK SYSTEM

SUMMARY

A primary object of the invention disclosed herein is to provide a polish rod jack system for oil well pumping units that utilize sucker rod type bottom hole pumps; to space and fine tune the bottom hole pumps, while the pumping unit is in operation to maximize production, in a timely and relatively inexpensive manner.

Another object of the invention is to provide a polish rod jack system that will allow an increase in bottom hole pump service life by the ease of timely proper pump spacing to prevent the bottom hole pump plunger from bumping the bottom or top of the bottom hole pump and causing damage and premature failure.

Another object of the invention is to provide an automatic shutdown of the prime mover capability, in the event of pumping unit or system failure or malfunction indicated by either high or low hydraulic pressure, to prevent further damage to the equipment.

A feature of the invention is a switchgage to allow monitoring of the polish rod load, indicated on the switchgage dial face calibrated in both PSI and polish rod load in pounds.

Another feature of the invention is to provide a quick-disconnect fitting for rapid disconnection and connection of the hydraulic ram for well servicing.

Another feature of the invention is to provide a quick-disconnect fitting at a remote hydraulic manifold to allow rapid connection and disconnection of a portable hydraulic pump to allow bottom hole pump respacing in a safe, timely and relatively inexpensive manner, without undue climbing on and around hazardous equipment.

Another object of the invention is to provide a polish rod jack system for use on smaller pumping units where hazardous climbing is not a problem and the switchgage capability is not required or desired; where only the hydraulic ram and male end of a quick-disconnect fitting is semi-permanently installed to the pumping unit, and the connecting hose, gage and hydraulic pump remain portable to be used with several polish rod jack systems.

BRIEF DESCRIPTION OF THE DRAWINGS

FIG. 1 is a perspective view showing the polish rod jack system installed and the pumping unit ready for operation.

FIG. 2 is a view of the hollow hydraulic ram, showing the fitting arrangement at the ram.

FIG. 3 is a side view of the switchgage and fitting arrangement at the switchgage.

FIG. 4 is a schematic view showing the polish rod jack system when the gage is used as a portable unit with the hydraulic pump.

DESCRIPTION OF THE PREFERRED EMBODIMENTS

The polish rod jack system is shown in FIG. 1 with the hollow hydraulic ram 1 in position atop the carrier bar 4 and connected through a hydraulic conduit to an input manifold fitting 7. The hydraulic conduit disclosed in FIG. 1 includes the hydraulic hose 2A leading to hydraulic tubing 3A, hydraulic hose 2, and hydraulic tubing 3. The hydraulic tubings 3 and 3A are attached to the Sampson post 5, walking beam 14 and horse head 13, respectively, with conventional tubing clamps 15.

FIG. 3 shows tubing 3 connected to 90 degree fitting 6, and fitting 6 connected to "T" fitting 7 which serves as a manifold and provides an attachment point for the male end of a quick-disconnect fitting 8 and switchgage adaptor 9. Adaptor 9 provides an attachment point for switchgage 10. Conventional type switchgage 10 is coupled to electrical conduit 11 as seen in FIG. 1 to provide protection for electrical wiring from switchgage 10 to prime mover control circuit (not shown).

Referring to FIG. 2, the ram 1 is shown with a 45-degree fitting 12 terminating in a male quick-disconnect fitting 8A adapted to easily connect with a female quick-disconnect fitting, identical to the quick-disconnect fitting 23 (FIG. 4), coupled to flexible hose 2A without interference from the carrier bar 4.

The female end of the quick disconnect-fittings such as 23 and the male end of quick-disconnect fittings 8 and 8A are of the conventional type that can be connected and disconnected with pressure trapped in the male section of quick-disconnect fittings 8 and 8A to preclude the use of shut-off valves and pressure bleed apparatus. Hydraulic hose 2A is connected to make quick-disconnect fitting 8A to allow rapid disconnection and removal of ram 1 during well servicing operations and to provide a flexible connection between ram 1 and hydraulic tubing 3A. Moreover, hose 2A is of sufficient length to allow the changing of distance and angle between carrier bar 4 and the bottom of the horse head 13 without binding or stressing, as the pumping unit reciprocates.

Hydraulic hose 2 is of sufficient length to provide a flexible connection between tubing 3A and tubing 3 to allow reciprocal movement of the walking beam 14 in relation to the Sampson post 5 without binding or stressing.

In the operation of the polish rod jack system as depicted in FIG. 1, the female section of a quick-disconnect fitting from a hydraulic pump hose (not shown) is attached to the male end of the quick-disconnect fitting 8; pressure from the hydraulic pump is applied, opening the internal valves of the quick-disconnect fittings to establish a hydraulic flow from the pump to ram 1. The ram 1 can now be pumped to raise the ram piston 18, thereby raising polish rod clamp 16 which is firmly clamped to the polish rod 17 comprising the top section of the sucker rod string which is attached to the plunger of the bottom hole pump. The action causes the plunger of the bottom hole pump to reciprocate in a higher section of the barrel of the bottom hole pump, in effect re-spacing the bottom hole pump.

To lower the rod string, the operating control valve at the hydraulic pump can be opened and the weight of the sucker rod string exerted on the top of ram piston 18 through polish rod clamp 16 will push piston 18 into ram 1, causing the hydraulic fluid to flow back through the circuit to the hydraulic pump reservoir. When the sucker rod string is lowered the desired amount, the operating control valve at the hydraulic pump is closed and the bottom hole pump plunger is now reciprocating in a lower section of the bottom hole pump barrel, in effect re-spacing the bottom hole pump.

The switchgage 10 as shown in FIGS. 1 and 3 is a conventional type switchgage with both adjustable high and low pressure contact points to close an electrical control circuit to stop a prime mover in the event of higher or lower than normal hydraulic pressure is caused by higher or lower sucker rod string weight due to malfunctions or failure of the bottom hole pump, rod string or the polish rod jack system, to preclude further damage to the equipment. The switchgage dial face is dual calibrated to read both hydraulic pressure in pounds per square inch (PSI) and the polish rod load as calculated to the working surface in the ram 1.

Another embodiment of the polish rod jack system is illustrated in FIG. 4 showing the ram 1 installed atop the carrier bar 4 with a hydraulic hose 20 leading directly from ram 1 to a portable gage 22 and a hydraulic pump 21. To operate the polish rod jack system as illustrated in FIG. 4, the operator would need to stop the pumping unit, attach the female end of the quick-disconnect fitting 23 to the male end of the quick-disconnect fitting 8A. The hydraulic hose 20 is of sufficient length to allow th operator to remain at a safe distance from the moving equipment. The pumping unit can now be restarted and the operator can now re-space the bottom hole pump while the unit is in operation using the procedure as for the embodiment illustrated in FIG. 1. The minimum and maximum polish rod load can be be determined by monitoring gage 22. After re-spacing and/or monitoring the pumping unit, the operator can momentarily stop the pumping unit, disconnect the quick-disconnect fitting 23 from quick-disconnect fitting 8A and restart the pumping unit.

The polish rod jack system, as illustrated in FIG. 4, could be more practical for smaller pumping units where climbing is not a problem and the switchgage kill capability is not required or desired, while the polish rod jack system as illustrated in FIG. 1 could be more practical for larger pumping units where climbing is hazardous and the switchgage capability is desired.

The presently preferred embodiments of this invention are intended to cover both new fabrications and aftermarket modifications.

Various modifications of the polish rod jack system will become apparent to those persons ordinarily skilled in the art, and the present invention is intended to cover all such obvious modifications falling within the spirit and scope of the invention as defined in the appended claims.

I claim:

1. In an oil well pumping unit including a walking beam pivotally mounted in a stationary support and supporting a horse head for vertical reciprocal movement, and a carrier bar suspended from the horse head reciprocally carrying a polish rod constituting the upper section of a sucker rod for operating a bottom hole pump, a hydraulic polish rod jack system comprising:

(a) a hydraulic ram mounted on the carrier bar, (b) a ram piston mounted in said ram for vertical reciprocal movement, (c) support means operatively connected to the polish rod for vertical reciprocal movement of the polish rod with said ram piston, (d) a hydraulic conduit having first and second ends, (e) a hydraulic quick-disconnect inlet fitting mounted on the stationary support and connected to said first end of said hydraulic conduit, said inlet fitting being adapted to be quickly connected to and disconnected from a pressurized source of hydraulic fluid, (f) a hydraulic fliud quick-disconnect ram fitting on said ram, said ram fitting being adapted to be quickly connected to and disconnected from said second end of said hydraulic conduit, (g) at least portions of said hydraulic conduit being flexible, (h) clamp means holding portions of said conduit on the stationary support and on at least a portion of the horse head or the walking beam, so that said ram is in continuous fluid communication with said inlet fitting, even during the reciprocal movement of said ram.

2. The invention according to claim 1 in which said hydraulic conduit comprises a first flexible hose extending from said ram to at least the horse head, and one end of said first hose constituting said second end of said conduit.

3. The invention according to claim 2 in which said hydraulic conduit further comprises a first tubing section clamped by said clamping means on at least a portion of the horse head or the walking beam, a second tubing section clamped by said clamping means on said stationary support, and a second flexible hose section connecting said first and second tubing sections.

* * * * *